US010842264B1

(12) United States Patent
Savryha et al.

(10) Patent No.: US 10,842,264 B1
(45) Date of Patent: Nov. 24, 2020

(54) FLEXIBLE DESK ORGANIZER

(71) Applicants: Vitalii Savryha, Dnepr (UA); Volodimir I. Vavrenyuk, Kamianske (UA)

(72) Inventors: Vitalii Savryha, Dnepr (UA); Volodimir I. Vavrenyuk, Kamianske (UA)

( * ) Notice: Subject to any disclaimer, the term of this patent is extended or adjusted under 35 U.S.C. 154(b) by 0 days.

(21) Appl. No.: 16/860,604

(22) Filed: Apr. 28, 2020

(51) Int. Cl.

| | |
|---|---|
| ***A47B 47/00*** | (2006.01) |
| ***A47B 97/00*** | (2006.01) |
| ***B43M 99/00*** | (2010.01) |
| ***A47B 96/20*** | (2006.01) |

(52) U.S. Cl.
CPC ..... *A47B 47/0091* (2013.01); *A47B 97/00* (2013.01); *B43M 99/008* (2013.01); *A47B 2096/209* (2013.01); *Y10S 211/01* (2013.01)

(58) Field of Classification Search
CPC ..... A47B 47/0091; A47B 97/00; A47B 63/00; A47B 2096/209; A47F 7/146; Y10S 211/01; A47G 2023/0666; A47G 2200/10; A47G 2200/103; A47G 2200/106; B43M 99/008; B43M 99/009; B43M 99/001; A45C 11/34; A45C 11/36
USPC ..... 211/11, 10, 126.1, 41.6, 26.2, 2, 133.6, 211/69.1, 195, DIG. 1, 71.01; 206/371, 206/214, 224, 575; D19/75, 77, 92, 95, D19/99
See application file for complete search history.

(56) References Cited

U.S. PATENT DOCUMENTS

| | | | | |
|---|---|---|---|---|
| 3,552,817 A * | 1/1971 | Marcolongo | A47B 87/02 312/107 |
| 3,557,965 A * | 1/1971 | Agerholm | A47B 63/00 211/11 |
| 3,718,261 A * | 2/1973 | Woofter | A47F 7/00 211/69.1 |
| 4,163,497 A * | 8/1979 | McEwen | B42F 17/12 211/11 |
| 4,429,796 A * | 2/1984 | Sussman | B43M 99/008 206/558 |
| 4,802,593 A * | 2/1989 | Romanos | B43M 99/00 211/10 |
| 4,941,576 A * | 7/1990 | Sugarman | B42D 5/006 206/214 |
| 4,975,137 A * | 12/1990 | Cross | B43M 99/008 156/223 |

(Continued)

*Primary Examiner* — Jennifer E. Novosad
(74) *Attorney, Agent, or Firm* — Lawrence G. Fridman, Esq; Feigin & Fridman, LLC

(57) ABSTRACT

A modular desk organizer which includes a flexible base including which includes a plurality of engagement segment, each including a first engagement mechanism, and a plurality of connecting segments. Each pair of adjacent ones of the plurality of engagement segments is separated by one of the plurality of connecting segments, and the connecting segments have a smaller material thickness than the engagement segments. The modular desk organizer further includes at least one compartment holder reversibly engaged with at least one of the plurality of engagement segments. The at least one compartment holder including a recess for receiving a storage compartment and a second, corresponding engagement mechanism in engagement with the first engagement mechanism of the at least one of the plurality of engagement segments.

20 Claims, 6 Drawing Sheets

(56) References Cited

U.S. PATENT DOCUMENTS 5,046,789 A * 9/1991 Lee ..... A47B 87/0276 312/108
D325,395 S * 4/1992 Tu ..... D19/65
5,154,299 A * 10/1992 Hwang ..... A47B 55/00 211/11
5,224,594 A * 7/1993 Hou ..... B43M 99/001 206/214
D344,289 S * 2/1994 Roberts ..... D10/103
5,531,517 A * 7/1996 Alpen ..... A47F 3/004 312/111
5,660,276 A * 8/1997 Winnard ..... B25H 3/06 206/350
5,755,321 A * 5/1998 Wang ..... B43M 99/008 206/214
5,765,695 A * 6/1998 Picciallo ..... A47F 7/146 211/40
5,775,046 A * 7/1998 Fanger ..... A47B 81/06 108/157.16
5,820,095 A * 10/1998 Stone ..... B43K 23/00 248/316.7
6,170,676 B1 * 1/2001 Patadia ..... A47L 19/04 211/41.3
D450,921 S * 11/2001 Kirkland ..... D19/77
6,578,706 B2 * 6/2003 Thompson ..... A45C 3/02 206/214
6,763,954 B1 * 7/2004 Travers ..... A47L 19/02 211/41.3
9,380,885 B1 * 7/2016 Nguyen ..... A47D 11/00
10,028,596 B2 * 7/2018 Markwick ..... A47F 5/005
10,420,419 B2 * 9/2019 Kasravi ..... A47B 47/0091
2003/0160052 A1 * 8/2003 Mulaw ..... A47B 63/00
2005/0098510 A1 * 5/2005 Lom ..... G09F 7/18 211/13.1
2005/0224392 A1 * 10/2005 Perry ..... B25H 3/00 206/750
2007/0272630 A1 * 11/2007 De Luca ..... B42F 7/145 211/11
2008/0017596 A1 * 1/2008 Brock ..... A45D 33/26 211/10
2008/0118671 A1 * 5/2008 Bienkiewicz ..... A47G 9/062 428/12
2008/0213540 A1 * 9/2008 Alford ..... B60N 3/048 428/156
2014/0036518 A1 * 2/2014 Schaak ..... B43M 99/006 362/410
2014/0252929 A1 * 9/2014 Reasoner ..... A47B 63/00 312/237
2014/0263111 A1 * 9/2014 Micek ..... A47L 19/04 211/41.6
2015/0335149 A1 * 11/2015 Vickers ..... B43M 99/008 211/10
2017/0231466 A1 * 8/2017 Lee ..... A47L 19/04 211/41.6
2019/0313788 A1 * 10/2019 Sheldon ..... F16B 5/07

* cited by examiner

FLEXIBLE DESK ORGANIZER

FIELD AND BACKGROUND OF THE DISCLOSED TECHNOLOGY

The disclosed technology relates generally to desk organizers, and, more specifically, to a flexible and modular desk organizer suitable for use on tops of desks having different configurations.

Current desk organizers provide various compartments for storage of items one typically stores n a desk, such as pens, pencils, writing notes, and the like. However, current desk organizers are rigid, and include compartments in fixed places. As such, the existing organizers e unsuitable, or have limited use, in desks that are not fully planar, such as desks having recesses, shelves, or varying heights. Additionally, the locations and dimensions of the compartments are fixed, and as such, in order to have a specific desired desk organizer, a user must search for the specific arrangement of compartments they like in various stores, and has no control over the arrangement of the compartments.

There is thus a need in the art for a desk organizer which is flexible, and in which the user can control the arrangement of the compartments.

SUMMARY OF THE DISCLOSED TECHNOLOGY

The disclosed technology relates generally to desk organizers, and, more specifically, to a flexible and modular desk organizer suitable for use on tops of desks having different configurations.

According to an embodiment of the disclosed technology, there is provided a modular desk organizer. The modular desk organizer includes a flexible base including which includes a plurality of engagement segment, each including a first engagement mechanism and having a first material thickness, and a plurality of connecting segments each having a second material thickness and a width. Each pair of adjacent ones of the plurality of engagement segments is separated by one of the plurality of connecting segments, and the second material thickness is smaller than the first material thickness. The modular desk organizer further includes at least one compartment holder reversibly engaged with at least one of the plurality of engagement segments. The at least one compartment holder including a recess for receiving a storage compartment and a second, corresponding engagement mechanism in engagement with the first engagement mechanism of the at least one of the plurality of engagement segments.

In some embodiments, the modular desk organizer further includes at least one storage compartment disposed in the recess of the at least one compartment holder.

In some embodiments, the at least one of the plurality of engagement segments has embedded therein a first magnet as the first engagement mechanism, and the compartment holder has embedded therein a second magnet as the second corresponding engagement mechanism, such that the compartment holder is reversibly engaged to the at least one engagement segment by attraction of the first and second magnets. In some embodiments, wherein each of the plurality of engagement segments includes a resilient compartment adapted to snugly and reversibly receive the first magnet therein. In some embodiments, the first magnet of one of the plurality of engagement segments has a different shape that the first magnet of a different one of the plurality of engagement segments.

In other embodiments, the at least one of the plurality of engagement segments includes a plurality of upwardly facing protrusions as the first engagement mechanism, and the compartment holder includes a plurality of corresponding downwardly facing protrusions as the second corresponding engagement mechanism, such that the compartment holder is reversibly engaged with the at least one engagement segment by reversible interleaving of the upwardly facing protrusions and the downwardly facing protrusions.

In some embodiments, the flexible base is resilient. In some such embodiments, the flexible base is formed of at least one of rubber, silicone, and flexible plastic.

In some embodiments, the flexible base further includes a gripping tab, engageable by a user to lift the base from a surface.

In some embodiments, the flexibility of said base is dependent on at least one of a ratio between the first material thickness and the width, and a ratio between the second material thickness and the width.

In accordance with an embodiment of the disclosed technology, there is provided a kit for forming a modular desk organizer. The kit includes a flexible base, which includes a plurality of engagement segment, each including a first engagement mechanism and a first material thickness, and a plurality of connecting segments each having a second material thickness and a width. Each pair of adjacent ones of the plurality of engagement segments is separated by one of the plurality of connecting segments, and the second material thickness is smaller than the first material thickness. The kit further includes at least one compartment holder adapted to reversibly engage at least one of the plurality of engagement segments. The at least one compartment holder includes a recess for receiving a storage compartment and a second, corresponding engagement mechanism adapted for engagement with the first engagement mechanism of the at least one of the plurality of engagement segments. The kit also includes at least one storage compartment, adapted to be received in the recess of the at least one compartment holder.

In some embodiments, at least one of the plurality of engagement segments is adapted to have embedded therein a first magnet as the first engagement mechanism, and the compartment holder is adapted to have embedded therein a second magnet as the second corresponding engagement mechanism, and the kit further includes the first and second magnets, such that when the first magnet is embedded within at least one of the plurality of engagement segments and the second magnet is embedded within the compartment holder, the compartment holder is adapted to reversibly engage the at least one engagement segment by attraction of the first and second magnets. In some embodiments, the first magnet is embedded within at least one of the plurality of engagement segments, and the second magnet is embedded within the compartment holder. In some embodiments, each of the plurality of engagement segments includes a resilient compartment adapted to snugly and reversibly receive the first magnet therein. In some embodiments, the first magnet of one of the plurality of engagement segments has a different shape than the first magnet of a different one of the plurality of engagement segments.

In some embodiments, at least one of the plurality of engagement segments includes a plurality of upwardly facing protrusions as the first engagement mechanism, and the compartment holder includes a plurality of corresponding downwardly facing protrusions as the second, corresponding engagement mechanism, such that the compartment holder is adapted to be reversibly engaged with the at least one engagement segment by reversible interleaving of the upwardly facing protrusions and the downwardly facing protrusions.

In some embodiments, the flexible base is resilient. In some such embodiments, the flexible base is formed of at least one of rubber, silicone, and flexible plastic.

In some embodiments, the flexible base further includes a gripping tab, engageable by a user to lift the base from a surface.

In some embodiments, the flexibility of the base is dependent on at least one of a ratio between the first material thickness and the width, and a ratio between the second material thickness and the width.

BRIEF DESCRIPTION OF THE DRAWINGS

FIGS. 4A and 1-B are, respectively, a top view planar illustration and a bottom view planar illustration of the base of FIGS. 2 and 3.

DETAILED DESCRIPTION OF EMBODIMENTS OF THE DISCLOSED TECHNOLOGY

In an embodiment of the disclosed technology, a flexible base includes embedded magnets. One or more compartment holders, each including at least one embedded magnet, are placed at desired locations on the flexible base such that the embedded magnets of the base attract the embedded magnet(s) of the compartment holder(s). A storage compartment, such as a cup or paper holder, is placed in each compartment holder, thereby to form a desk organizer according to the disclosed technology.

According to an aspect of some embodiments of the disclosed technology, there is provided a modular desk organizer. The modular desk organizer includes a flexible base including which includes a plurality of engagement segment, each including a first engagement mechanism, and a plurality of connecting segments. Each pair of adjacent ones of the plurality of engagement segments is separated by one of the plurality of connecting segments, and the connecting segments have a smaller material thickness than the engagement segments. The modular desk organizer further includes at least one compartment holder reversibly engaged with at least one of the plurality of engagement segments. The at least one compartment holder including a recess for receiving a storage compartment and a second, corresponding engagement mechanism in engagement with the first engagement mechanism of the at least one of the plurality of engagement segments.

Embodiments of the disclosed technology will become clearer in view of the following description of the drawings.

Figure 1A:
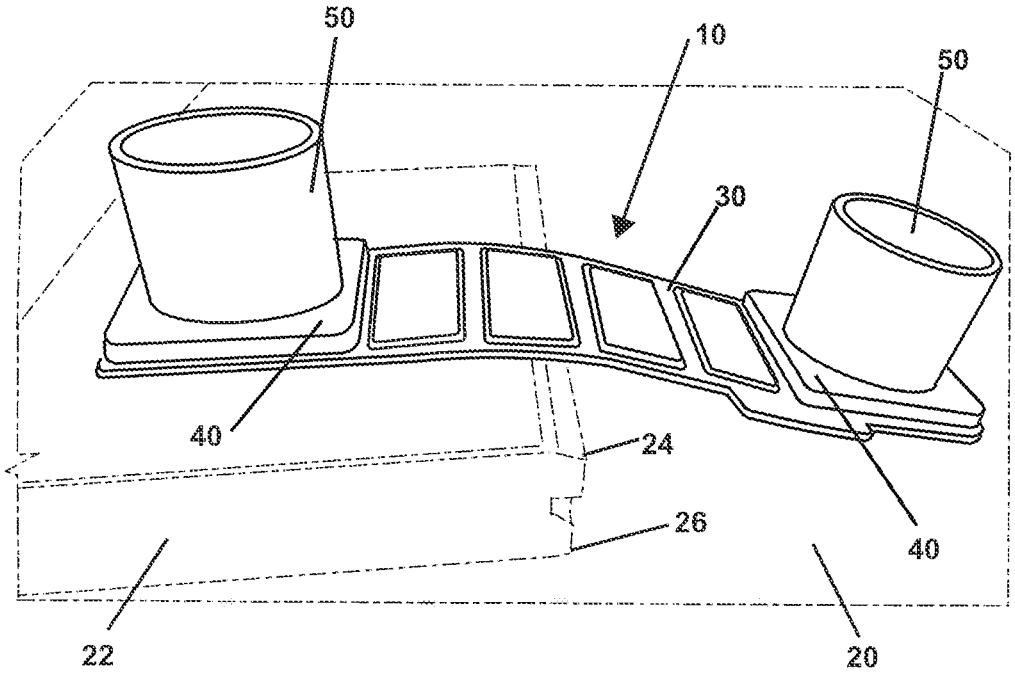
FIGS. 1A and 1B are, respectively, a perspective view illustration and a planar side view illustration of a flexible desk organizer according to an embodiment of the disclosed technology, in use on a multi-level desk.
Figure 1B:
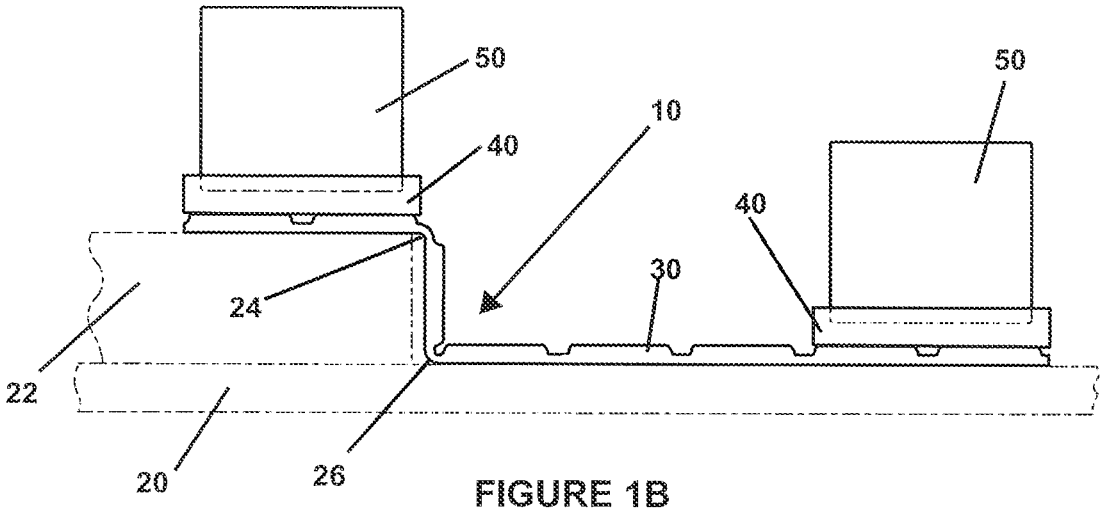

Reference is now made to FIGS. 1A and 1B which are, respectively, a perspective view illustration and a planar side view illustration of a flexible desk organizer 10 according to an embodiment of the disclosed technology, in use on a desk 20 having an elevated portion 22.

As seen, the flexible desk organizer 10 includes a flexible base 30, having mounted thereon a pair of compartment holders 40, each having disposed therein a storage compartment 50 for storage of desk items, such as pencils, paper clips, note papers, and the like.

As seen, in FIG. 1A, the flexible desk organizer 10 is simply placed on desk 20, such that a portion of the flexible desk organizer 10 is stable on the elevated portion 22 of desk 20, and the remainder of flexible desk organizer 10 slopes towards the surface of desk 20, in an unstable manner.

In FIG. 1B, the flexible desk organizer 10 has been arranged such that the flexible base 30 thereof is folded along a corner 24 of the elevated portion 22 of the desk, and along a corner 26 at which the elevated portion 22 engages the desk 20. In this arrangement, all portions of base 30 are either horizontal or vertical. More specifically, the regions of base 30 including compartment holders 40 and storage compartments 50 are arranged horizontally on the upper surfaces of elevated portion 22 and of desk 20, such that the storage compartments 50 are stable and accessible on desk 20. The folding, or flexing, of flexible base 30 at corners 24 and 26 is facilitated by connecting segments of the base having a reduced thickness, as explained in detail hereinbelow with respect to FIGS. 2 to 4B.

Figure 2:
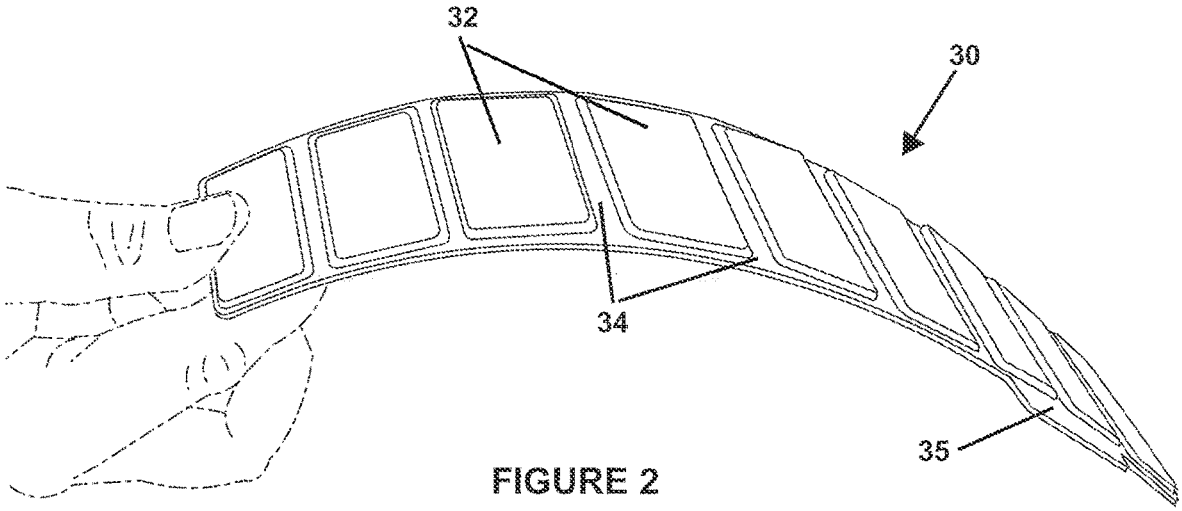
FIG. 2 is a front view perspective illustration of a flexible base of the flexible desk organizer of FIG. 1.
Figure 3:
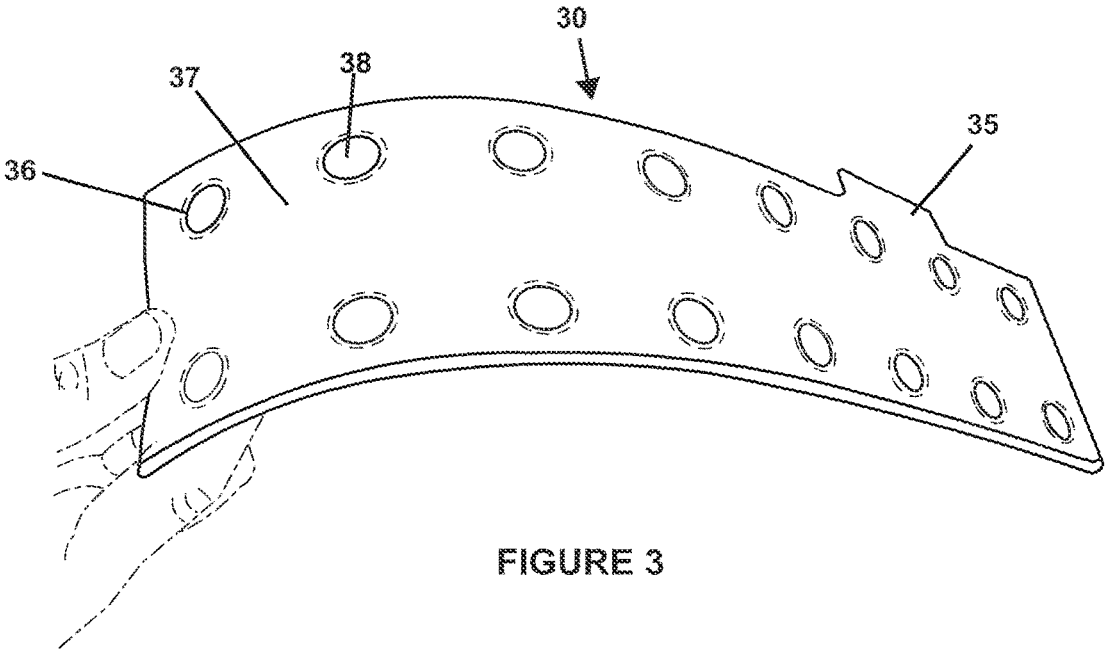
FIG. 3 is a back-view perspective illustration of a flexible base of the flexible desk organizer of FIG. 1.
Figure 4A:
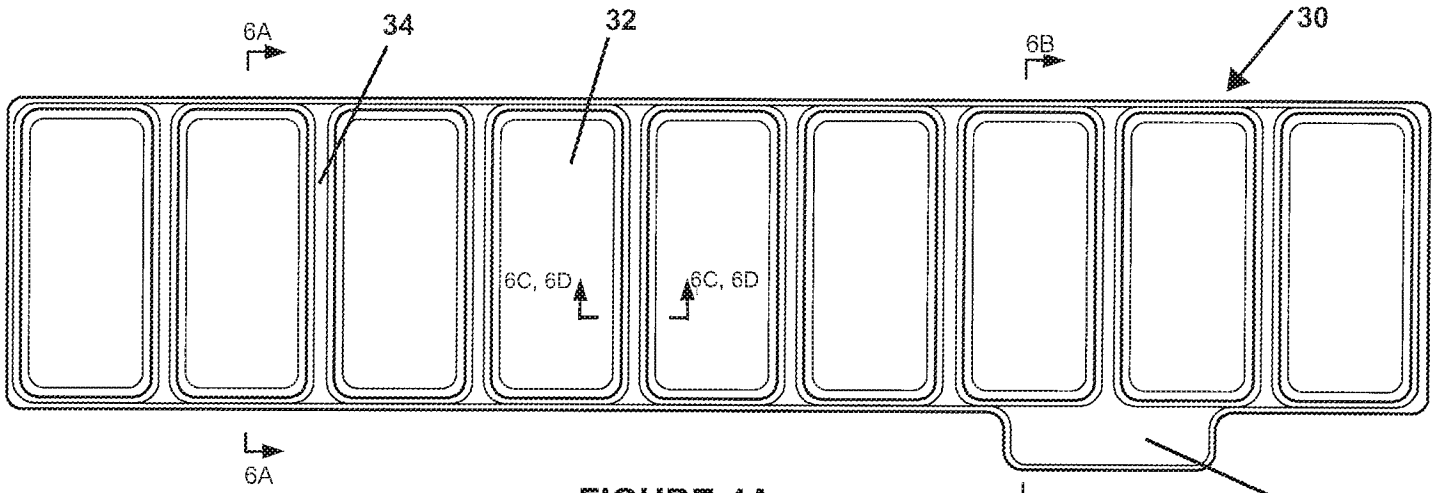
Figure 4B:
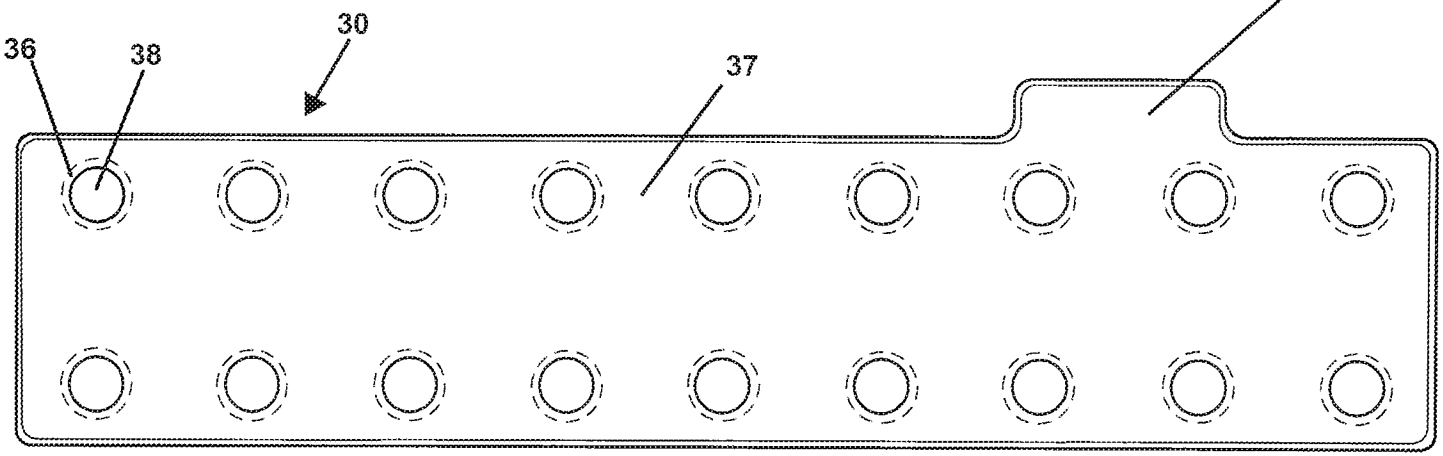
Figure 5A:
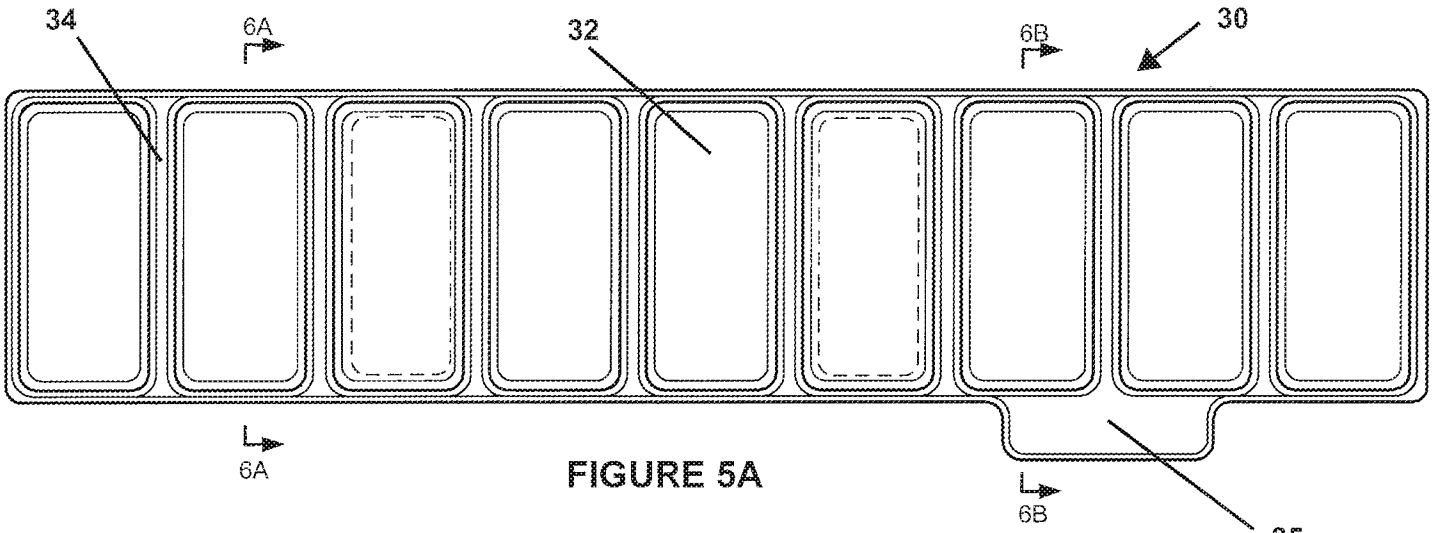
FIGS. 5A and 5B are, respectively, a top view planar illustration and a bottom view planar illustration of a second embodiment of a base suitable for the flexible desk organizer of FIG. 1.
Figure 5B:
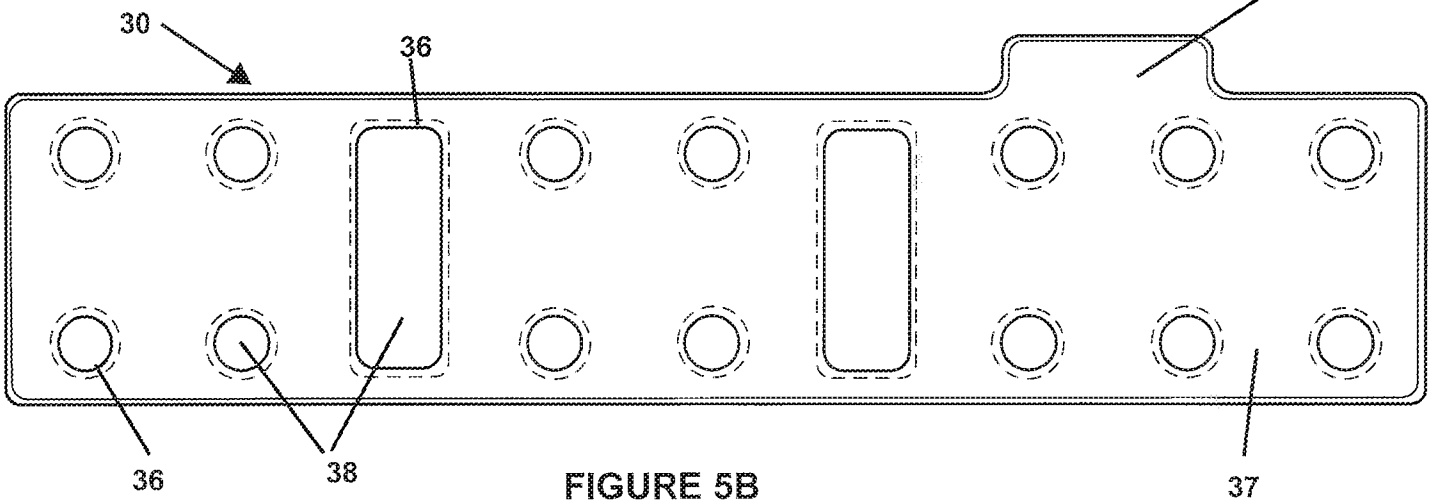

Reference is now made to FIG. 2, which is a front view perspective illustration of flexible base 30 of flexible desk organizer 10 of FIG. 1, to FIG. 3, which is a back view perspective illustration of flexible base 30, to FIGS. 4A and 4B, which are, respectively, a top view planar illustration and a bottom view planar illustration of flexible base 30, to FIGS. 5A and 5B, which are, respectively, a top view planar illustration and a bottom view planar illustration of a second embodiment of flexible base 30, and to FIGS. 6A, 6B, 6C, and 6D, which are sectional illustrations of various sections of flexible base 30.

As seen, base 30 includes a plurality of engagement segments 32, interconnected by connecting segments 34. In some embodiments, base 30 further includes a gripping tab 35 to lake it easier for the user to lift the base 30 after it has been placed on a desk.

Although in the illustrated embodiment engagement segments 32 are shown as rectangular segments, the engagement segments may be of any suitable shape or dimensions. Base 30 is typically formed of a flexible, and in some embodiments also resilient, material, such as rubber, soft plastic, silicone, and the like. In some embodiments, the material of base 30 has a Shore A value in the range of 25 to 60.

Figure 6A:
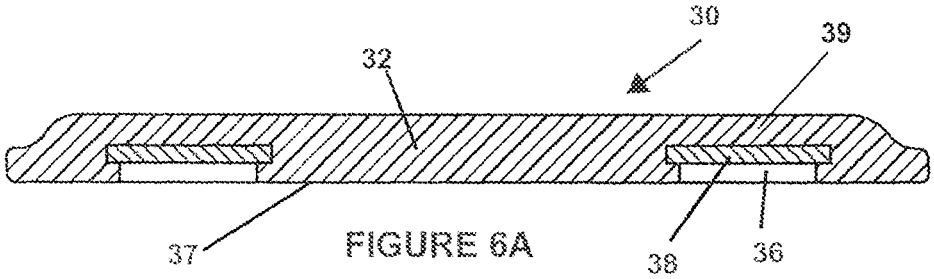
FIGS. 6A, 6B, 6C, and 6D are sectional illustrations of various sections of the base of FIGS. 2 to 4B, taken along respective section lines in FIG. 4A.
Figure 6B:
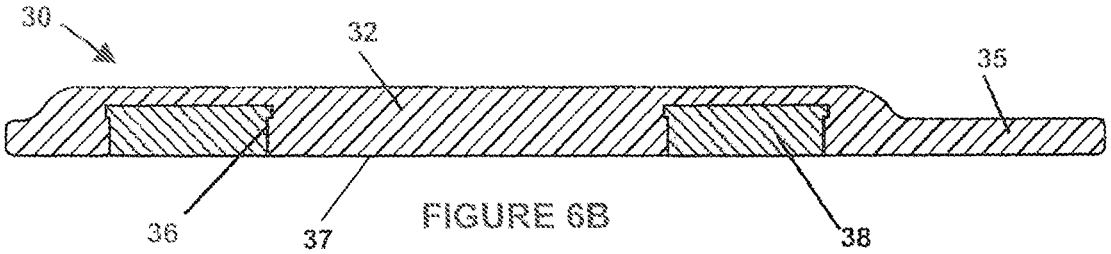
Figure 6C:
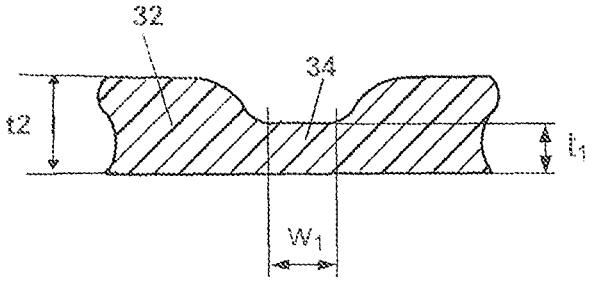
Figure 6D:
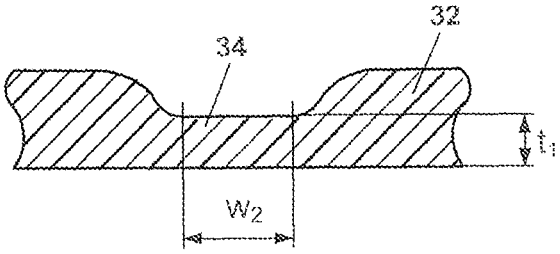

As seen clearly in FIGS. 6C to 6D, connecting segments 34 have a first material thickness $t_1$, and engagement segments 32 have a second material thickness $t_2$, greater than $t_1$. The reduced material thickness at connecting segments 34, together with the flexible material from which flexible base 30 is formed, provide the flexibility of base 30 and facilitate matching of the base to contours of a desk or other object on which the base is placed, as illustrated in FIGS. 1A and 1B.

Additionally, the connecting segments 34 have a width therebetween. FIG. 6C shows a first width w1 while FIG. 6D shows a second width w2, greater than width w1. The flexibility of the base 30 is dependent on the ratio between the thickness and the width of the connecting segments 34, namely the ratio t1/w1 or t1/w2. The lower the ratio, the greater the flexibility of the base, and its ability to adapt to different surfaces. In some embodiments, the ratio t1/w1 or t1/w2 is in the range of ⅕ to 1/10, ⅙ to 1/10, or ⅛ to 1/10.

Similarly, the ratio between the thickness t2 of the engagement segments 32 and the width of the connecting segments 34, namely the ratio t2/w1 or t2/w2 impacts the flexibility of the base, such that the lower the ratio the greater the flexibility of the base. In some embodiments, the ratio t2/w1 or t2/w2 is in the range of ½ to ⅙, ⅓ to ⅙, or ⅕ to ⅙.

A plurality of indentations 36 are formed on a lower surface 37 of base 30, beneath engagement segments 32, such that a magnet 38 is embedded in each such indentation 36. In some embodiments, such as that illustrated in FIGS. 3 and 4B, multiple magnets 38 may be embedded beneath each engagement segment 32. In other embodiments, such as that illustrated in FIG. 5B, at least some of engagement segments 32 have a single magnet 38 embedded thereunder. As seen in FIG. 5B, different engagement segments 32 may have different shaped magnets embedded therein, which span different portions of the area of the engagement segment. Specifically, in FIG. 5B, some of the magnets are circular "dot" magnets, while others are rectangular magnets spanning most of the area of the engagement segment.

In some embodiments, magnets 38 do not fill indentations 36, as seen in FIG. 6A. In such embodiments, an air gap may exist between magnets 38 and the desk, when lower surface 37 of the base is placed on the desk. Additionally, as seen in FIG. 6A, in some embodiments, magnets 38 may be pressured into their place such that a portion 39 of the base may extend over a portion of the magnets, thereby ensuring that the magnets 38 don't move or shift relative to lower surface 37. The ability pressure the magnets 38 into place, as shown, in FIG. 6A, is based on the resiliency of the indentations 36 and the flexibility of the material of base 30, such that the magnets are snugly retained upon insertion into the indentations, but can also be removed or replaced by suitable flexing of the base, when desired.

In other embodiments, such as that illustrated in FIG. 6B, the magnets 38 fill the entire space of indentations 36, such that a surface of magnets 38 is flush with lower surface 37 of base 30.

In yet other embodiments (not explicitly shown), the magnets 38 may be embedded in suitable compartments, or gaps, within the material thickness of engagement segments 32, In such embodiments, lower surface 37 of base 30, as well as upper surfaces of engagement segments 32, appear uniform and sealed.

Although in the illustrated embodiment, flexible base 30 has an elongate, rectangular structure, it is appreciated that the base may have any suitable shape or configuration. For example, the base may be square, or may have multiple elongate portions extending from a hub, such as in an X or + shape.

Figure 7A:
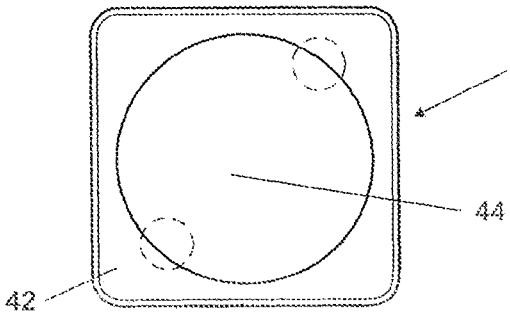
FIGS. 7A, 7B, and 7C, are, respectively, planar top, bottom, and side view illustrations of a compartment holder forming part of the flexible desk organizer of FIG. 1.
Figure 7B:
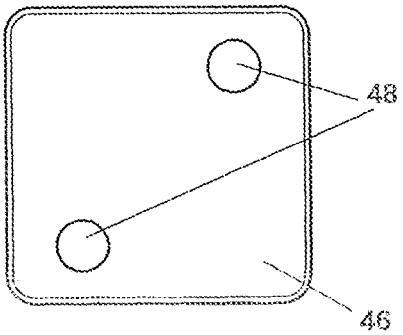
Figure 7C:
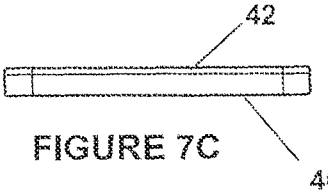

Reference is now made to FIGS. 7A, 7B, and 7C, which are, respectively, planar top, bottom, and side view illustrations of a compartment holder 40 forming part of flexible desk organizer 10.

As seen in FIGS. 7A to 7C, compartment holder 40 has an upper surface 42 including a recess 44 for receiving a storage compartment, as described hereinbelow. Compartment holder 40 further includes a lower surface 46, having embedded therein at least one magnet 48, adapted to cooperate with magnets 38 of flexible base 30, as explained in further detail hereinbelow. The magnet(s) 48 may be arranged at any suitable location(s) within lower surface 46 of compartment holder 40. Typically, the arrangement of magnets 48 corresponds to the arrangement of magnets 38 (FIG. 3).

Although compartment holder 40 is shown as a square element in the illustrated embodiment, it is appreciated that the compartment holder may have any suitable outline and contour, based on the desired application and on the shape of the base.

Figure 8:
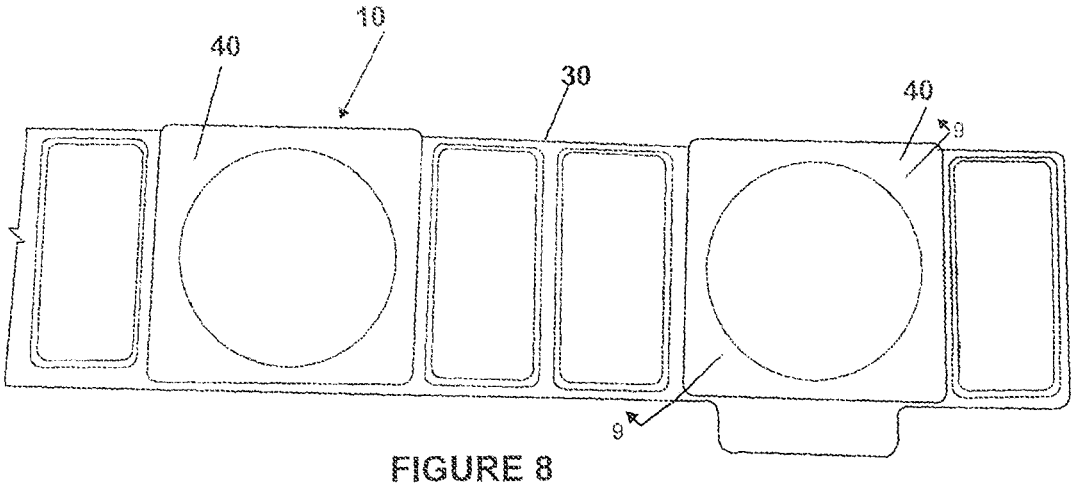
FIG. 8 is a top view planar illustration of the base of FIGS. 2 to 4B, having mounted thereon two compartment holders of FIGS. 7A to 7C.

Additionally, the compartment holder 40 may be adapted to engage multiple engagement regions 32 of base 30, as shown in FIG. 8 described hereinbelow. Alternatively, the compartment holder 40 may be adapted to engage a single engagement region 32, or even a portion of an engagement region 32.

In some embodiments (not explicitly illustrated) lower surface 46 of compartment holder 40 may include a downwardly protruding frame, adapted to be disposed around engagement segments 32 and to extend within connecting segments 34. In such embodiments, the frame may further ensure that the compartment holder remains fixed relative to base 30, during use thereof.

Figure 9:
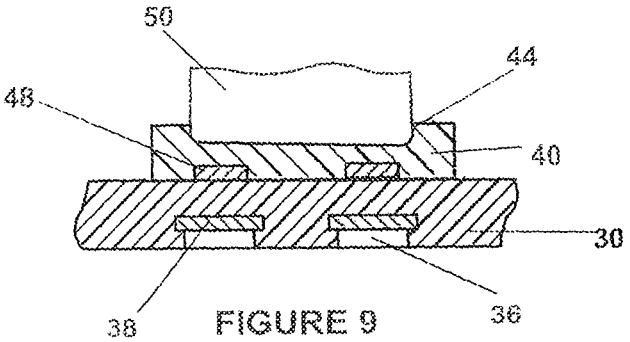
FIG. 9 is a sectional illustration of arrangement of FIG. 8, having disposed therein a storage compartment, the sectional illustration taken along respective section lines in FIG. 8.

Reference is now made to FIG. 8, which is a top view planar illustration of flexible base 30 of FIGS. 2 to 4B, having mounted thereon two compartment holders 40 of FIGS. 7A to 7C, and to FIG. 9, which is a sectional illustration of arrangement of FIG. 8, having disposed therein a storage compartment 50, the sectional illustration taken along respective section lines in FIG. 8.

As seen in FIG. 8, two compartment holders 40 are placed over flexible base 30. In the illustrated embodiment, each compartment holder 40 spans two engagement regions 32, and the compartment holders 40 are in parallel placement along the base 30. However, any other arrangement, as suitable for the purposes of the user, is considered within the scope of the invention. For example, the base may have only a single compartment holder disposed thereon, or more than two compartment holders. The compartment holders disposed on the base may be identical to one another, as in the illustrated embodiment, or may be different from one another, for example in shape, dimension, and/or purpose. For example, one of the two compartment holders may be a compartment holder similar to that shown and suitable to receive, as the storage compartment, a circular cup for pens, whereas another of the compartment holders may be rectangular, and may include a rectangular recess 44 suitable for receiving a rectangular container for holding note papers.

Turning to FIG. 9, it is seen that storage container 50 is disposed within recess 44 of compartment holder 40, and extends outwardly therefrom. Additionally, compartment holders 40 are arranged such that magnets 48 thereof are aligned with, and are attracted to, magnets 38 of flexible base 30, such that compartment holder 40 is stable and in a fixed position relative to flexible base 30. However, given the reversible nature of magnetic attraction, the fact that compartment holders 40 are magnetically held to flexible base 30 provides the modularity of desk organizer 10, and enables the user to change the position(s) of compartment holder(s), whenever desired.

Figure 10:
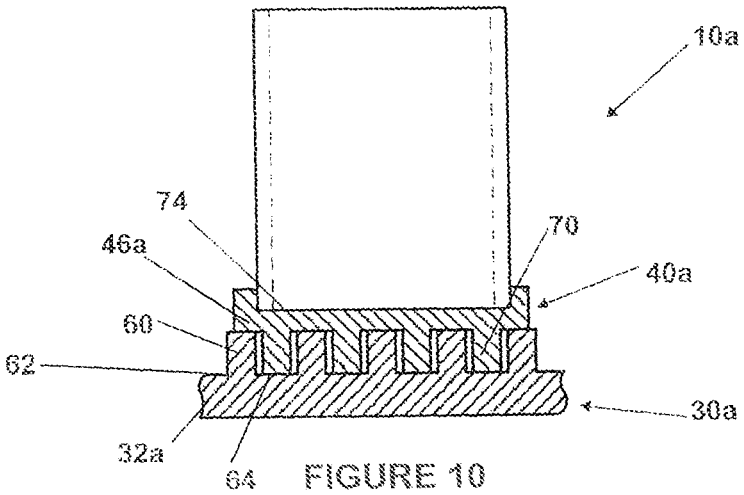
FIG. 10 is a sectional illustration of another embodiment of a flexible desk organizer according to the disclosed technology, the base and compartment holders having interlocking indentations.

Reference is now made to FIG. 10, which is a sectional illustration of a second embodiment of a flexible desk organizer 10*a* according to the disclosed technology, having a base 30*a* and a compartment holder 40*a* having interlocking indentations.

As seen in FIG. 10, in another embodiment of the disclosed technology, connecting segments 32*a* of base 30*a* include multiple protrusions 60 extending outwardly from an upper surface 62, the protrusions 60 separated by gaps 64. The compartment holder 40*a* includes multiple downwardly extending protrusions 70 extending downwardly from lower surface 46*a* thereof, the protrusions 70 separated by gaps 74. A storage compartment 50 is disposed in recess 44 of compartment holder 40*a*.

In use, compartment holder 40*a* is held to flexible base 30*a* by interleaving downwardly extending protrusions 70 in gaps 64 between protrusions 60 of base 30*a*, and protrusions 60 in gaps 74 between protrusions 70. In this arrangement, compartment holder 40*a* is stable, and fixed, relative to base 30*a*, and may easily be moved between different positions along the base, thus maintaining the modular nature of the desk organizer of the disclosed technology.

In some embodiments, magnets may be provided to reinforce the stability of the arrangement of FIG. 10. For example, magnets may be embedded in gaps 64 and at the lower ends of protrusions 70, which magnets attract each other when the compartment holder 40*a* is attached to base 30*a*, substantially as described above.

It will be appreciated by people of skill in the art that compartment holders may be reversibly attached to the base using many different mechanisms and arrangements, all of which are considered within the scope of the disclosed technology.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A modular desk organizer, comprising:

a flexible base including:

a plurality of engagement segments, each including a first engagement mechanism and having a first material thickness; and a plurality of connecting segments, each having a second material thickness and a width, wherein each pair of adjacent ones of said plurality of engagement segments is separated by one of said plurality of connecting segments, and wherein said second material thickness is smaller than said first material thickness; and at least one compartment holder engaged with at least one of said plurality of engagement segments, said at least one compartment holder including a recess for receiving a storage compartment and a second, corresponding engagement mechanism in engagement with said first engagement mechanism of said at least one of said plurality of engagement segments.

2. The modular desk organizer of claim 1, further comprising at least one storage compartment disposed in said recess of said at least one compartment holder.

3. The modular desk organizer of claim 1, wherein each of said plurality of engagement segments has embedded therein a first magnet as said first engagement mechanism, and said compartment holder has embedded therein a second magnet as said second corresponding engagement mechanism, such that said compartment holder is reversibly engaged to said at least one engagement segment by attraction of said first and second magnets.

4. The modular desk organizer of claim 3, wherein each of said plurality of engagement segments includes a resilient compartment adapted to snugly and reversibly receive said first magnet therein.

5. The modular desk organizer of claim 3, wherein said first magnet of one of said plurality of engagement segments has a different shape than that of said first magnet of a different one of said plurality of engagement segments.

6. The modular desk organizer of claim 1, wherein each of said plurality of engagement segments includes a plurality of upwardly facing protrusions as said first engagement mechanism, and said compartment holder includes a plurality of corresponding downwardly facing protrusions as said second corresponding engagement mechanism, such that said compartment holder is reversibly engaged with said at least one engagement segment by reversible interleaving of said upwardly facing protrusions and said downwardly facing protrusions.

7. The modular desk organizer of claim 1, wherein said flexible base is resilient.

8. The modular desk organizer of claim 1, wherein said flexible base is formed of at least one of rubber, silicone, and flexible plastic.

9. The modular desk organizer of claim 1, wherein said flexible base further includes a gripping tab, engageable by a user to lift said base from a surface.

10. The modular desk organizer of claim 1, wherein flexibility of said base is a function of at least one of:

a ratio between said first material thickness and said width; and a ratio between said second material thickness and said width.

11. A kit for forming a modular desk organizer, comprising:

a flexible base including:

a plurality of engagement segments, each including a first engagement mechanism and a first material thickness; and a plurality of connecting segments, each having a second material thickness and a width, wherein each pair of adjacent ones of said plurality of engagement segments is separated by one of said plurality of connecting segments, and wherein said second material thickness is smaller than said first material thickness, at least one compartment holder adapted to be engaged with at least one of said plurality of engagement segments, said at least one compartment holder including a recess for receiving [a] at least one storage compartment and a second, corresponding engagement mechanism adapted for engagement with said first engagement mechanism of said at least one of said plurality of engagement segments; and said at least one storage compartment, adapted to be received in said recess of said at least one compartment holder.

12. The kit of claim 11, wherein each of said plurality of engagement segments is adapted to have embedded therein a first magnet [as] at said first engagement mechanism, and said compartment holder has embedded therein a second magnet [as] of said second corresponding engagement mechanism, and wherein said kit further comprises said first and second magnets such that, when said first magnet is embedded within at least one of said plurality of engagement segments and said second magnet is embedded within said compartment holder, said compartment holder is adapted to be engaged with said at least one engagement segment by attraction of said first and second magnets.

13. The kit of claim 12, wherein said first magnet is embedded within at least one of said plurality of engagement segments, and said second magnet is embedded within said compartment holder.

14. The kit of claim 12, wherein each of said plurality of engagement segments includes a resilient compartment adapted to snugly and reversibly receive said first magnet therein.

15. The kit of claim 12, wherein said first magnet of one of said plurality of engagement segments has a different shape than that of the first magnet of a different one of said plurality of engagement segments.

16. The kit of claim 11, wherein each of said plurality of engagement segments includes a plurality of upwardly facing protrusions as said first engagement mechanism, and said compartment holder includes a plurality of corresponding downwardly facing protrusions as said second, corresponding engagement mechanism, such that said compartment holder is adapted to be engaged with said at least one engagement segment by reversible interleaving of said upwardly facing protrusions and said downwardly facing protrusions.

17. The kit of claim 11, wherein said flexible base is resilient.

18. The kit of claim 11, wherein said flexible base is formed of at least one of rubber, silicone, and flexible plastic.

19. The kit of claim 11, wherein said flexible base further includes a gripping tab, engageable by a user to lift said base from a surface.

20. The kit of claim 11, wherein flexibility of said base is a function of at least one of:

a ratio between said first material thickness and said width; and a ratio between said second material thickness and said width.

* * * * *